US006824231B2

(12) United States Patent
Jakob-Bamberg et al.

(10) Patent No.: US 6,824,231 B2
(45) Date of Patent: Nov. 30, 2004

(54) STORAGE CABINET

(75) Inventors: Rupert Jakob-Bamberg, Calgary (CA); Kevin Domagala, Calgary (CA)

(73) Assignee: Smed International, Calgary (CA)

( * ) Notice: Subject to any disclaimer, the term of this patent is extended or adjusted under 35 U.S.C. 154(b) by 9 days.

(21) Appl. No.: 10/301,965

(22) Filed: Nov. 22, 2002

(65) Prior Publication Data

US 2004/0100173 A1 May 27, 2004

(51) Int. Cl.[7] ..... A47B 97/00

(52) U.S. Cl. ..... 312/249.9; 211/162; 312/201; 312/317.1

(58) Field of Search ..... 312/249.9, 249.8, 312/249.11, 280, 201, 317.1; 211/162; 280/79.3

(56) References Cited

U.S. PATENT DOCUMENTS 3,752,550 A * 8/1973 Niemeyer ..... 312/237
4,784,446 A 11/1988 Newhouse ..... 312/317.1
5,070,556 A * 12/1991 Gloger ..... 5/308
6,199,966 B1 * 3/2001 Fulterer ..... 312/334.24
6,209,977 B1 * 4/2001 Vondrejs ..... 312/294
6,595,606 B1 * 7/2003 Gunst ..... 312/49.9

OTHER PUBLICATIONS

Smed Docking Tower brochure "Onward and Upward", publication date unknown.
Smed KYO brochure, pp. 1, 7 and 10, publication date unknown.

* cited by examiner

*Primary Examiner*—Ramon O Ramirez
(74) *Attorney, Agent, or Firm*—Flynn, Thiel, Boutell & Tanis, P.C.

(57) ABSTRACT

A storage cabinet for use in an office environment including a stationary housing defining a hollow interior which opens frontwardly, and a drawer-type cart defining storage space thereon which is movable into the interior of the housing when not in use and out of the housing when access to the storage space is desired. The cart mounts thereon a wheel or roller arrangement on a lower front end thereof for engagement with a floor surface, and a roller arrangement at an upper rear end thereof which is engaged within a track or rail mounted along a top of the housing so as to suspend a rear end of the cart therefrom.

29 Claims, 9 Drawing Sheets

STORAGE CABINET

FIELD OF THE INVENTION

This invention relates to an improved storage cabinet, such as for use in an office environment.

BACKGROUND OF THE INVENTION

The modern office has become crowded and cluttered due to the ever-increasing amount of equipment utilized by an office worker, such as a computer and the like, and at the same time the need to work on, handle and store large numbers of documents continues to significantly contribute to the overall clutter and crowdedness of the office. Accordingly, there is a need for storage units which efficiently utilize the available space in an office area for storage and organization of documents, books and other work-related items.

Many types of storage units exist, such as cabinets which are mounted in an overhead position with respect to a worksurface, freestanding pedestal units and drawer-type filing cabinets. The instant invention generally relates to the latter type of cabinet which is typically incorporated into a workstation or work area. More specifically, the instant invention relates to a cabinet which includes a stationary and hollow housing and a drawer-type cart positioned within the interior of the housing. The cart is equipped to store documents and other items and is storable within the housing when not in use, and movable out of the housing when access to the items stored thereon is desired.

A storage cabinet of the above type manufactured by the assignee hereof includes a housing and a cart movable relative thereto through a pair of rollers or wheels mounted at the front lower corners of the cart, and a pair of rollers or wheels mounted at the rear lower corners of the cart. A pair of tracks similar to conventional drawer slides are mounted on opposite sides of the cart so as to guide the cart relative to the housing during opening of the cabinet. This design, however, resulted in undesirable twisting and binding of the tracks during movement of the cart relative to the housing. In another version of this type of cabinet also manufactured by the assignee, the guide tracks were eliminated and the cart provided with front and rear sets of wheels. However, this design resulted in misalignment problems since the cart was completely separable from the housing. Further, the amount of force required to open the cabinet was large, particularly when the cabinet was positioned on a carpeted floor.

It is thus an object of this invention to provide an improved storage cabinet, particularly for use in an office environment, which is believed to significantly improve upon prior cabinets of this general type, and particularly is believed to overcome the disadvantages mentioned above.

More specifically, the storage cabinet according to the invention incorporates therein a track or rail provided on the top of the stationary housing which cooperates with a roller mounted on an upper portion of the movable cart. The cart additionally includes a roller arrangement at the lower front thereof for engagement with a floor surface. Movement of the cart relative to the housing is therefore controlled and guided through the engagement of the upper roller of the cart within the housing rail and the lower front rollers, which arrangement defines a three-point support for the movable cart. This type of support allows the cart to rock or pivot sidewardly about the housing rail which eliminates or at least greatly reduces binding of the cart. Further, less force is required to close the cabinet since only one wheel arrangement is in contact with the floor.

Other objects and purposes of the invention will be apparent to persons familiar with structures of this general type upon reading the following specification and inspecting the accompanying drawings.

Figure 1:
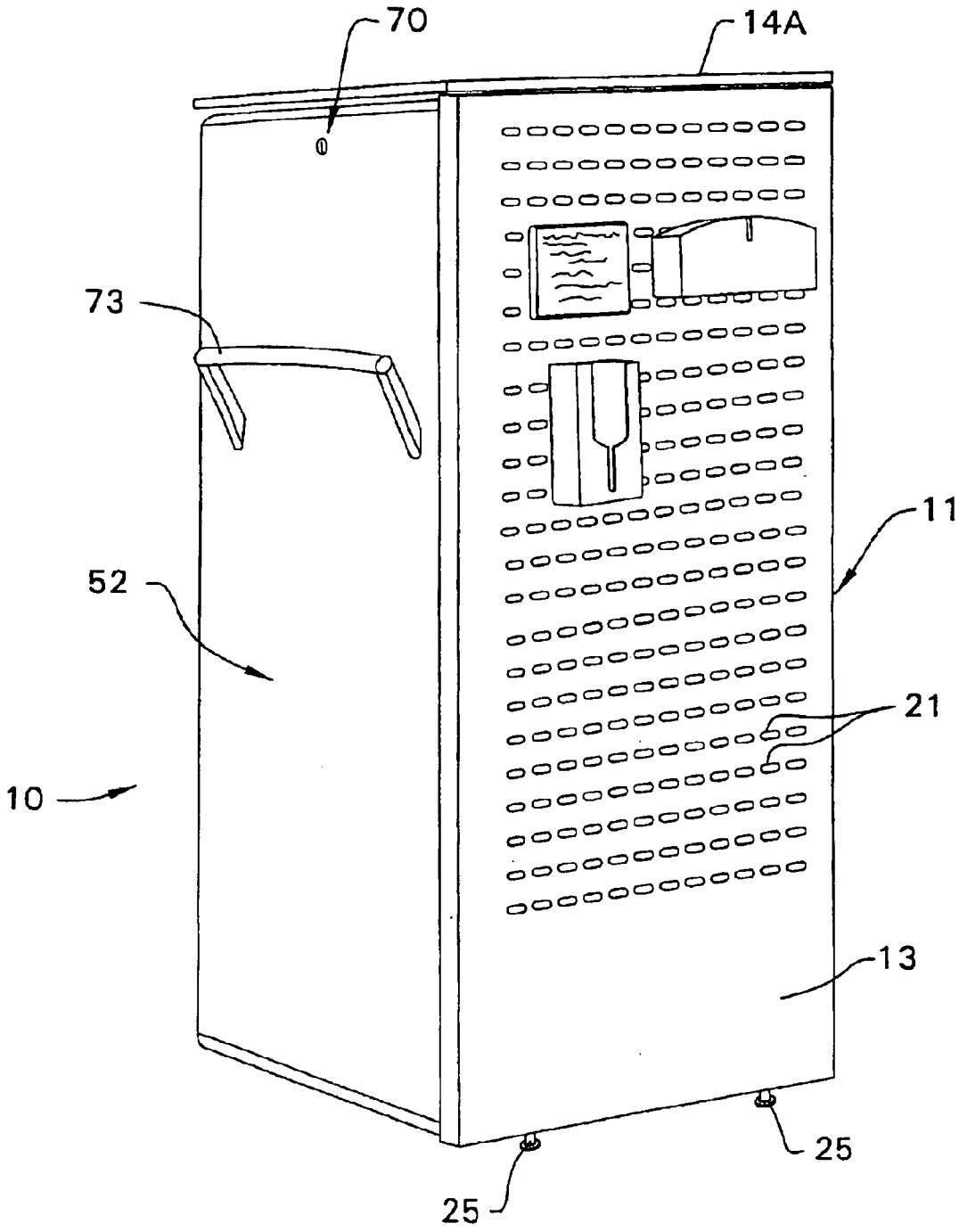
FIG. 1 is a perspective view illustrating a cabinet according to the present invention in a closed position.

Certain terminology will be used in the following description for convenience in reference only, and will not be limiting. For example, the words "upwardly", "downwardly", "rightwardly" and "leftwardly" will refer to directions in the drawings to which reference is made. The word "front" will be used to refer to the side of the cabinet from which the cart emerges, and "rear" will be used to refer to the opposite side of the cabinet. The words "inwardly" and "outwardly" will refer to directions toward and away from, respectively, the geometric center of the structure and designated parts thereof. Said terminology will include the words specifically mentioned, derivatives thereof, and words of similar import.

DETAILED DESCRIPTION

Figure 2:
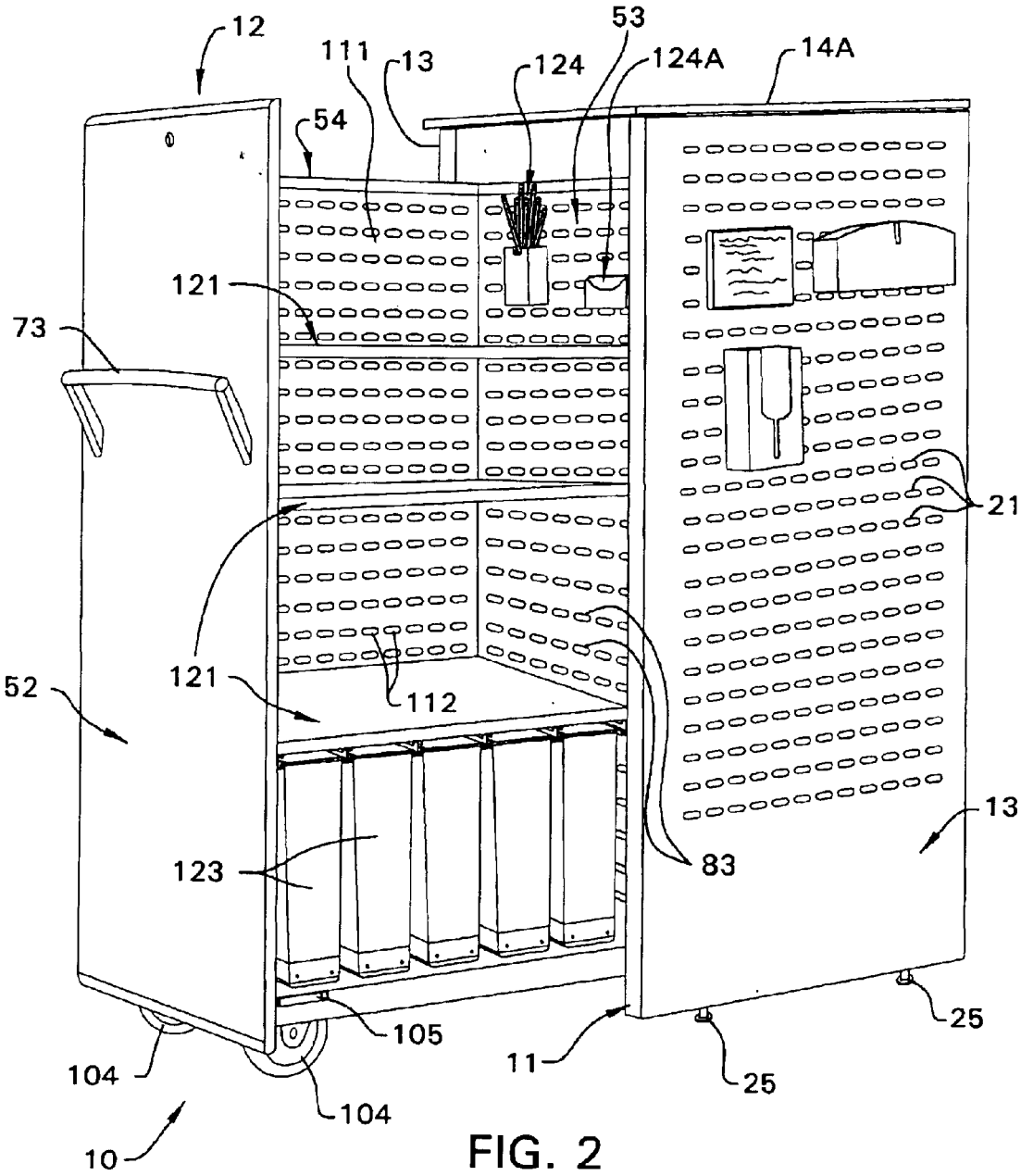
FIG. 2 is a perspective view similar to FIG. 1, but showing the cabinet in an open position.
Figure 3:
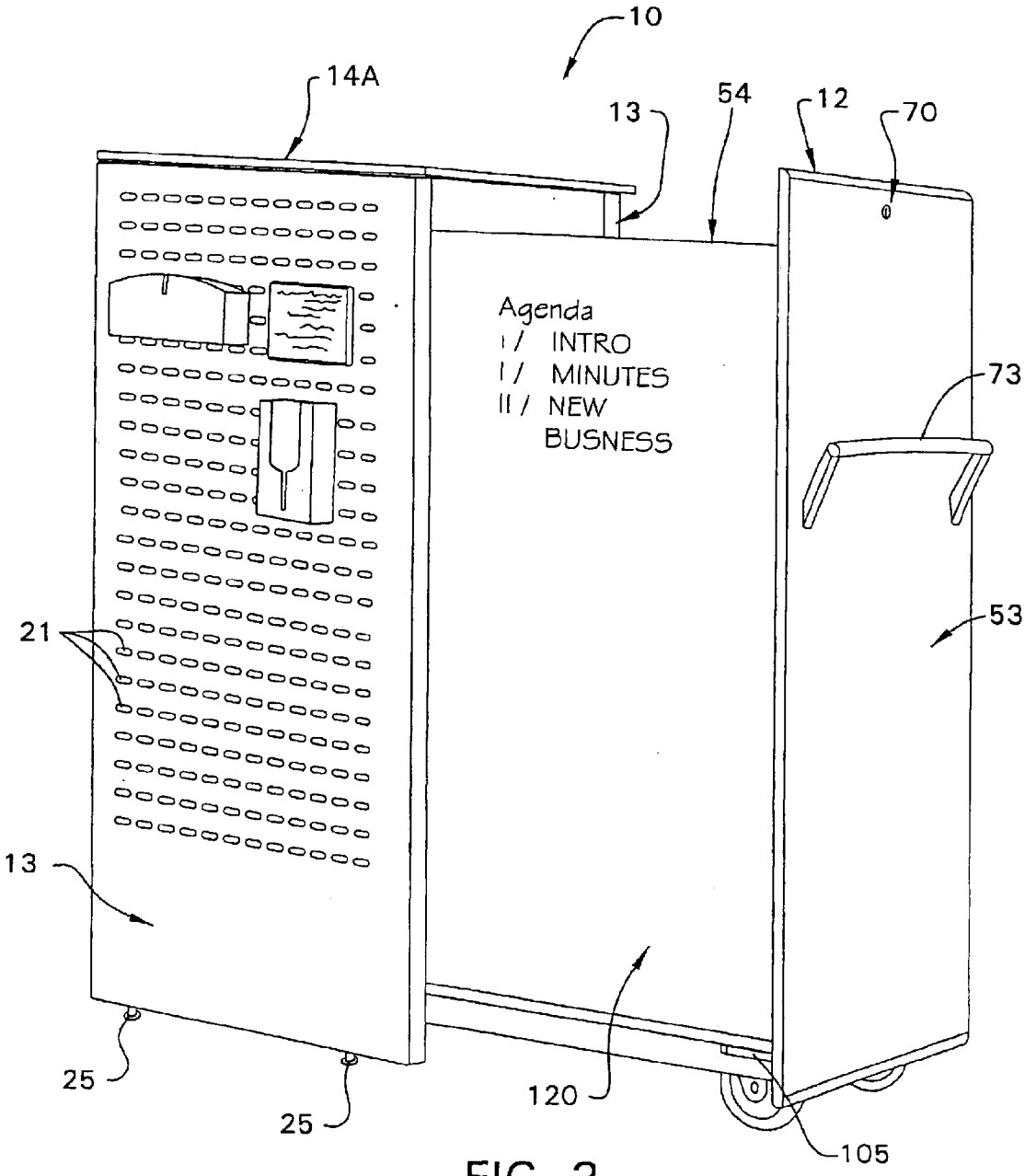
FIG. 3 is a perspective view similar to FIG. 2, but showing the opposite side of the cabinet from that shown in FIG. 2.

Referring to FIGS. 1–3, there is illustrated a storage unit or cabinet 10 intended for use in an office-type environment. The cabinet 10 generally includes a stationary housing 11 with a frontwardly-opening hollow interior and a wheeled cart 12 located within the housing interior.

The housing 11 is defined by a pair of generally upright, laterally-spaced and generally parallel side walls 13, a generally upright rear wall 14 which extends transversely between and interconnects the respective side walls 13, and a plate-like top or top wall 14A positioned at the upper edges of the respective side and rear walls so as to close off the top of the housing 11.

Figure 4:
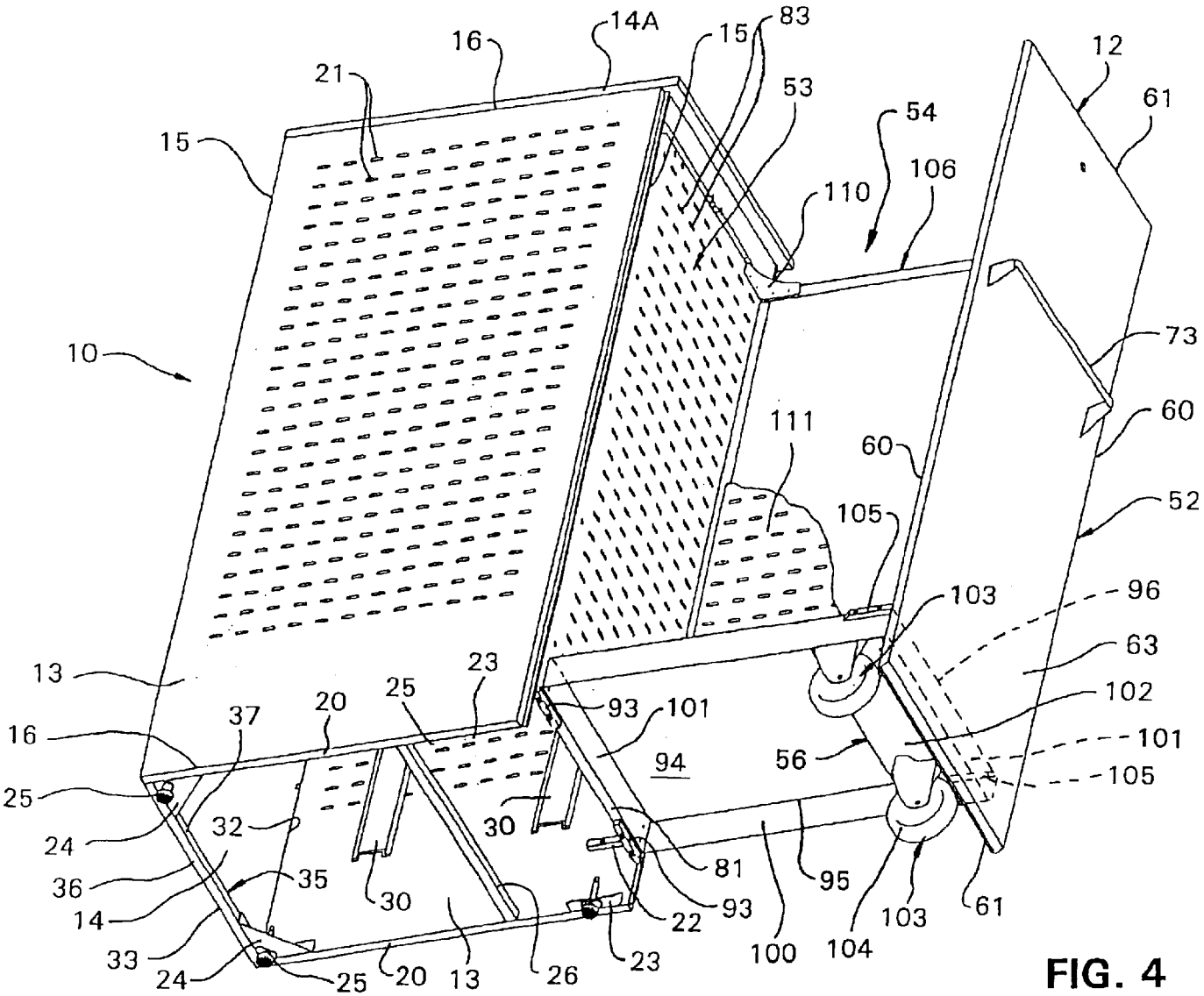
FIG. 4 is a bottom perspective view of the cabinet in an open configuration, and with the side wall 54 of the movable cart mounted on an opposite side of the cart from that shown in FIGS. 2 and 3 for illustrative purposes.
Figure 7:
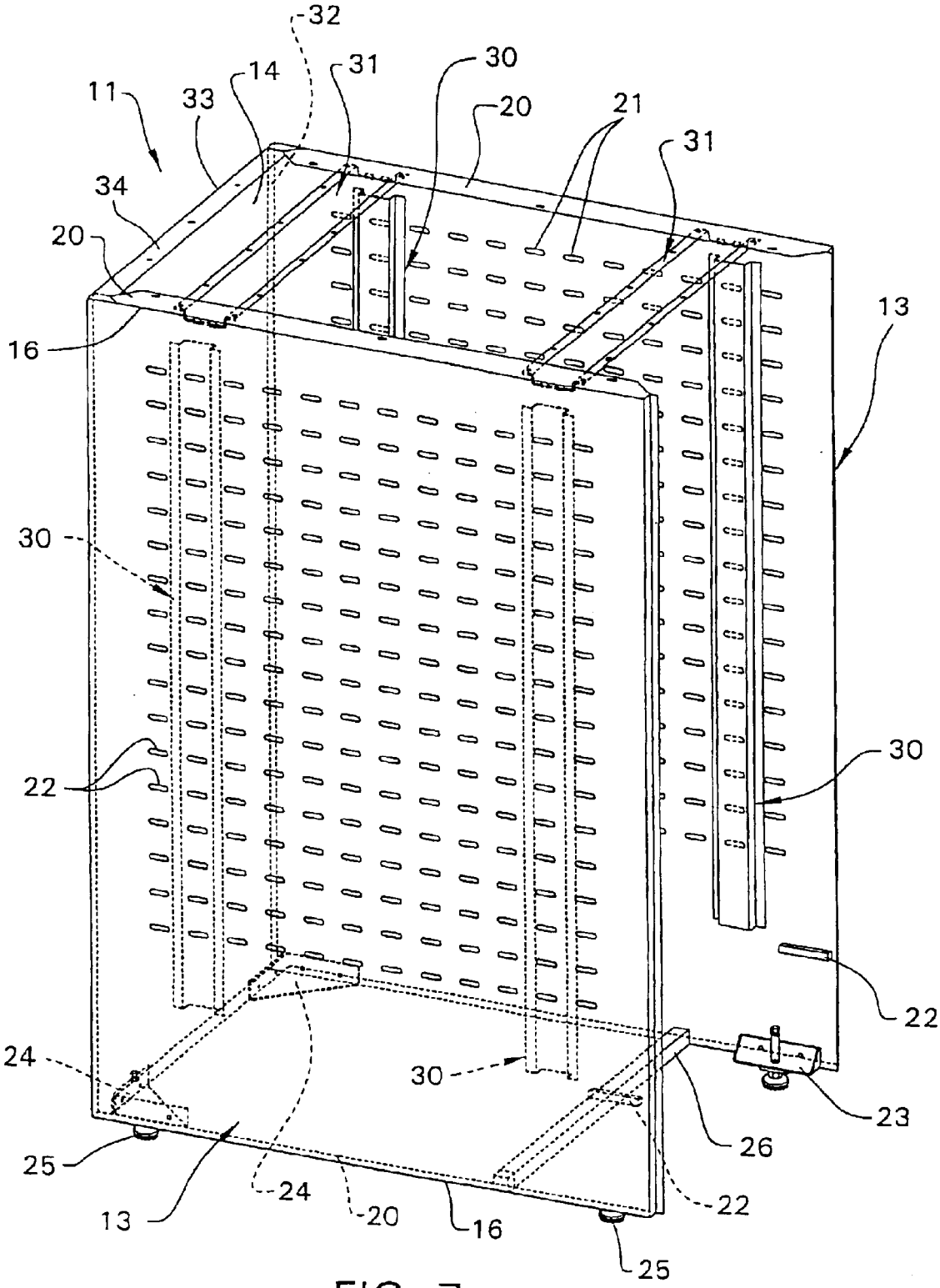
FIG. 7 is a perspective view of the housing of the cabinet without the top.

With reference to FIGS. 4 and 7, the side walls 13 are identical to one another, and only one of same will be described in detail herein. The side wall 13 includes a pair of vertically-oriented and generally parallel side edges 15 and a pair of horizontally-oriented and generally parallel upper and lower edges 16 which extend between the side edges 15. Upper and lower flanges 20 are connected to and bend inwardly a short horizontal distance from the respective upper and lower edges 16. The side wall 13 defines therein a plurality of slot-like openings 21 which in the illustrated embodiment are arranged in evenly-spaced horizontal rows and vertical columns. As discussed below, the openings 21 are configured for receiving hangers or mounting components associated with various accessories and work-related items which may be mounted to the cart 12 in a desired location.

Each side wall 13 mounts thereon a block-like guide member 22 adjacent front lower corner thereof, which guide members 22 are spaced a short distance upwardly from the respective lower edges 16. Each guide member 22 is an elongate and rigid member which is oriented generally horizontally in a front-to-back direction of the housing 11 so as to be generally parallel with the respective lower edge 16. Further, leveling foot assemblies are provided at the bottom of the housing 11. More specifically, a pair of identical front mounting brackets 23 are fixed to the respective side walls 13 adjacent frontwardly oriented portions of the respective lower flanges 20 a short vertical distance below the respective guide members 22, and a pair of identical rear mounting brackets 24 are fixed to the side and rear walls 13 and 14 at the rear lower corners of the housing 11. In the illustrated embodiment, the rear mounting brackets 24 are gussets. The front and rear mounting brackets 23 and 24 each mount thereon a foot 25 which is adjustable to allow leveling of the cabinet 10 relative to the floor surface.

As shown in FIGS. 4 and 7, a cross brace or stiffener 26 extends between and is fixed to the respective side walls 13 spaced rearwardly from the front mounting brackets 23. Further, a pair of elongate reinforcing elements 30 are provided on each side wall 13. The reinforcing elements 30 are generally channel-shaped and have flanges which are secured to the inner surfaces of the respective side walls 13 so that the elements 30 are oriented in a laterally-spaced and generally upright manner. A pair of upper reinforcing elements 31 are generally horizontally oriented and extend transversely between the upper edges 16 of the respective side walls 13. The upper reinforcing elements 31 are channel-shaped and have flanges which are secured to the lower surfaces of the opposed upper flanges 20 of side walls 13. The reinforcing elements 30 as well as the cross-brace 26 and upper braces 31 prevent twisting or racking of the side walls 13 relative to one another.

The rear wall 14 of housing 11 includes a pair of generally parallel and upright side edges 32 and a pair of generally parallel upper and lower edges 33. Upper and lower flanges 34 and 35 are bent inwardly from the respective upper and lower edges 33. Upper flange 34 projects inwardly from upper edge 33 and is generally horizontally oriented. Lower flange 35, as shown in FIG. 4, projects horizontally inwardly from lower edge 33 of rear wall 14 so as to define a generally horizontal base part 36, and then projects upwardly from an inner edge of base part 36 so as to define an upright part 37 which is generally parallel to and spaced forwardly from the inner surface of rear wall 14. Rear gussets 24 are attached to this upright part 37 of lower flange 35 and are additionally secured to the inner surface of the respective side wall 13. Rear wall 14 is fixed to rear edge portions of the respective side walls 13 along upright side edges 32 by bending either the rear edge portions of the respective side walls 13 or upright side edge portions of rear wall 14 to define a suitable flange structure through which fasteners can extend, or which may be welded to form housing 11.

Figure 6:
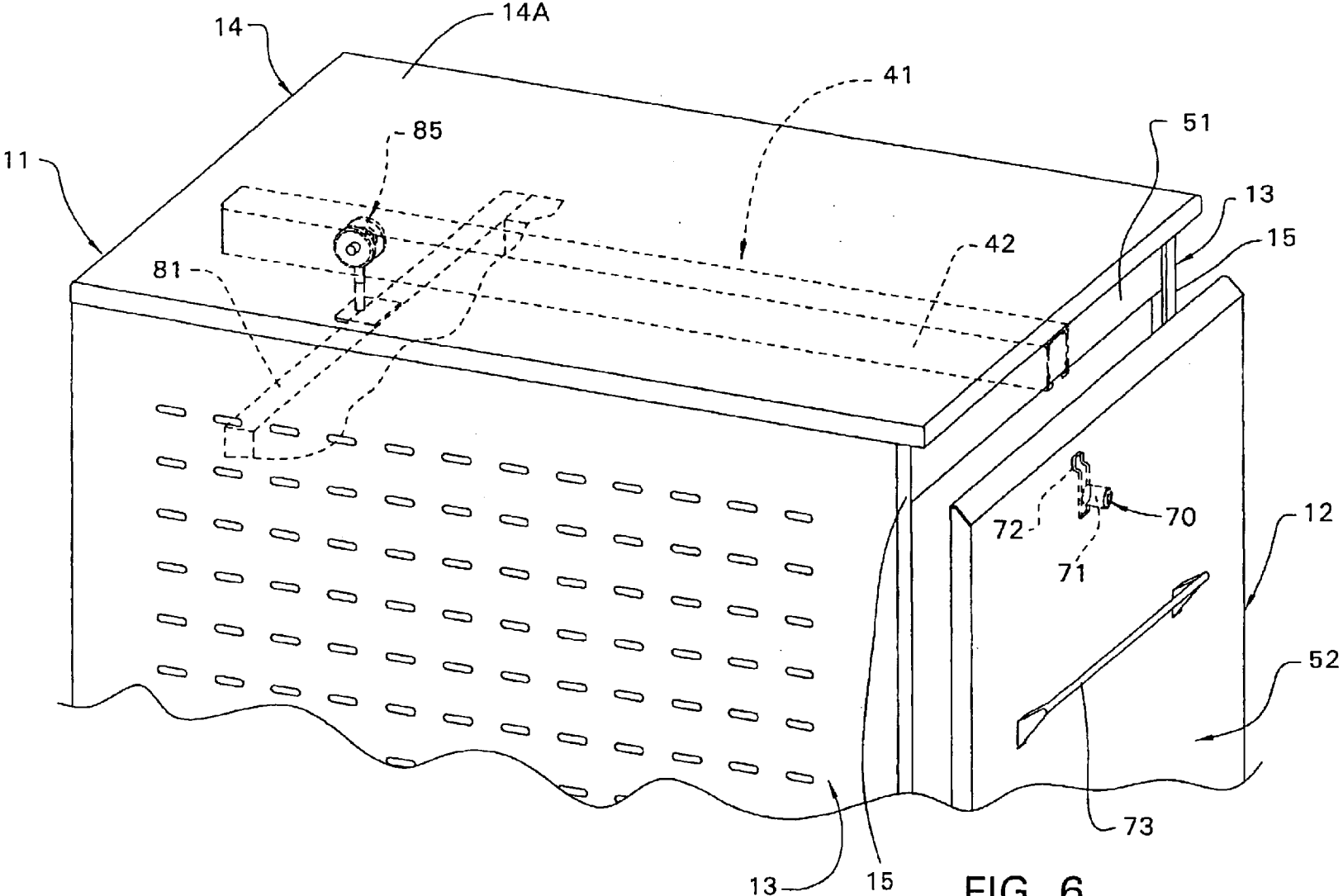
FIG. 6 is an enlarged, perspective, fragmentary view of the top of the cabinet in a partially opened configuration.
Figure 8:
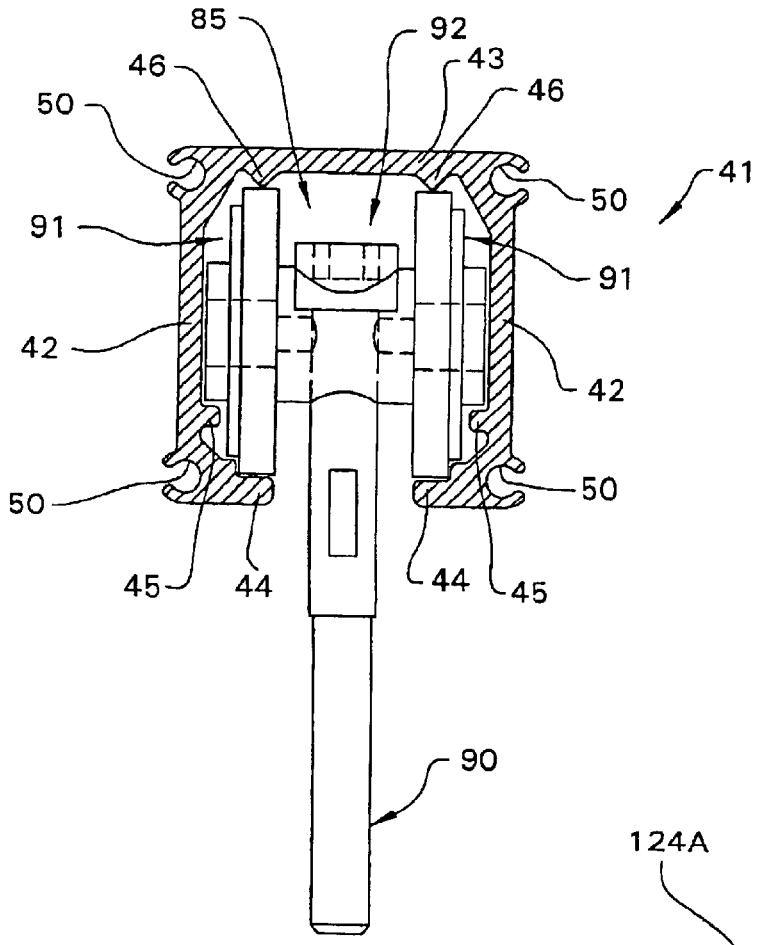
FIG. 8 is an enlarged, transverse cross-sectional view of the rail and roller assembly of the housing and cart, respectively.

As shown in FIGS. 6 and 8, a track or rail 41 is fixed to the undersides of the respective upper reinforcing elements 31 and is centered between and generally parallel with the respective side walls 13. The rail 41 has a length which is similar to a front-to-back or depth dimension of the cabinet 10. Rail 41 is of a downwardly-opening U-shape configuration defined by a pair of generally upright side walls 42 and a generally horizontally oriented top wall 43 which extends transversely between the respective side walls 42. A pair of bottom retaining flanges 44 extend inwardly towards one another from lower edges of the respective side walls 42. The inner or upwardly facing surfaces of the respective retaining flanges 44 are of a stepped configuration as shown in FIG. 8, and a pair of ribs 45 project inwardly from the respective side walls 42 a short distance above the respective retaining flanges 44 and serve as guides. A pair of sidewardly-spaced ribs or projections 46 are also provided along the inner surface of the top wall 43 of rail 41. The rail 41 is provided at each of its four corners with a generally cylindrical and horizontally extending mounting hole 50 each for receiving a fastening element.

Top wall 14A is attached to the upper flanges 20 and 34 of the side and rear walls 13 and 14, and may also be attached to upper reinforcing elements 31. As shown in FIG. 6, a face plate 51 is positioned below the front edge of top wall 14A, and extends between the front vertical side edges 15 of the respective side walls 13 so as to close off the open front end of rail 41. The front terminal end of the rail 41 is fixed to the face plate 51 by fasteners (not shown) which extend through the face plate 51 and into the holes 50 at the front end of rail 41. Similarly, the rear terminal end of the rail 41 is fixed to rear wall 14 of housing 11 by fasteners which extend through rear wall 14 and into the holes 50 at the rear end of rail 41.

Turning now to cart 12, same is defined by generally parallel front and rear walls 52 and 53, a side wall 54 which extends between the front and rear walls 52 and 53, and a bottom wall 55 which mounts thereon a wheel assembly 56 adjacent a front portion thereof.

Front wall 52 includes a pair of upright parallel side edges 60 and upper and lower horizontal and parallel edges 61. Front wall 52 is of a double-wall construction defined by inner and outer spaced-apart and generally parallel walls 62 and 63 (FIG. 10) which are attached to one another along their edges by suitable flanges or other appropriate method. As shown in dotted lines in FIG. 9, a plurality, and here three, of generally horizontally oriented and channel-shaped reinforcing elements 64 are provided in a vertically spaced manner with one another between the inner and outer walls 62 and 63. Inner wall 62 defines therein a plurality of slot-like openings 65 arranged in a similar pattern as the openings 21 in side walls 13 of housing 11. Further, a plurality of mounting pins or pegs 66 are provided along each of the upright side edges of inner wall 62 in uniformly and vertically-spaced relation with one another (only one of such side edges of inner wall 62 being shown in FIG. 10). The pins 66 are generally horizontally oriented and project rearwardly in generally parallel relation with bottom wall 55 and are generally perpendicular to inner wall 62. In the illustrated embodiment, five of such pins 66 are fixed to inner wall 62 along each upright side edge thereof.

Figure 9:
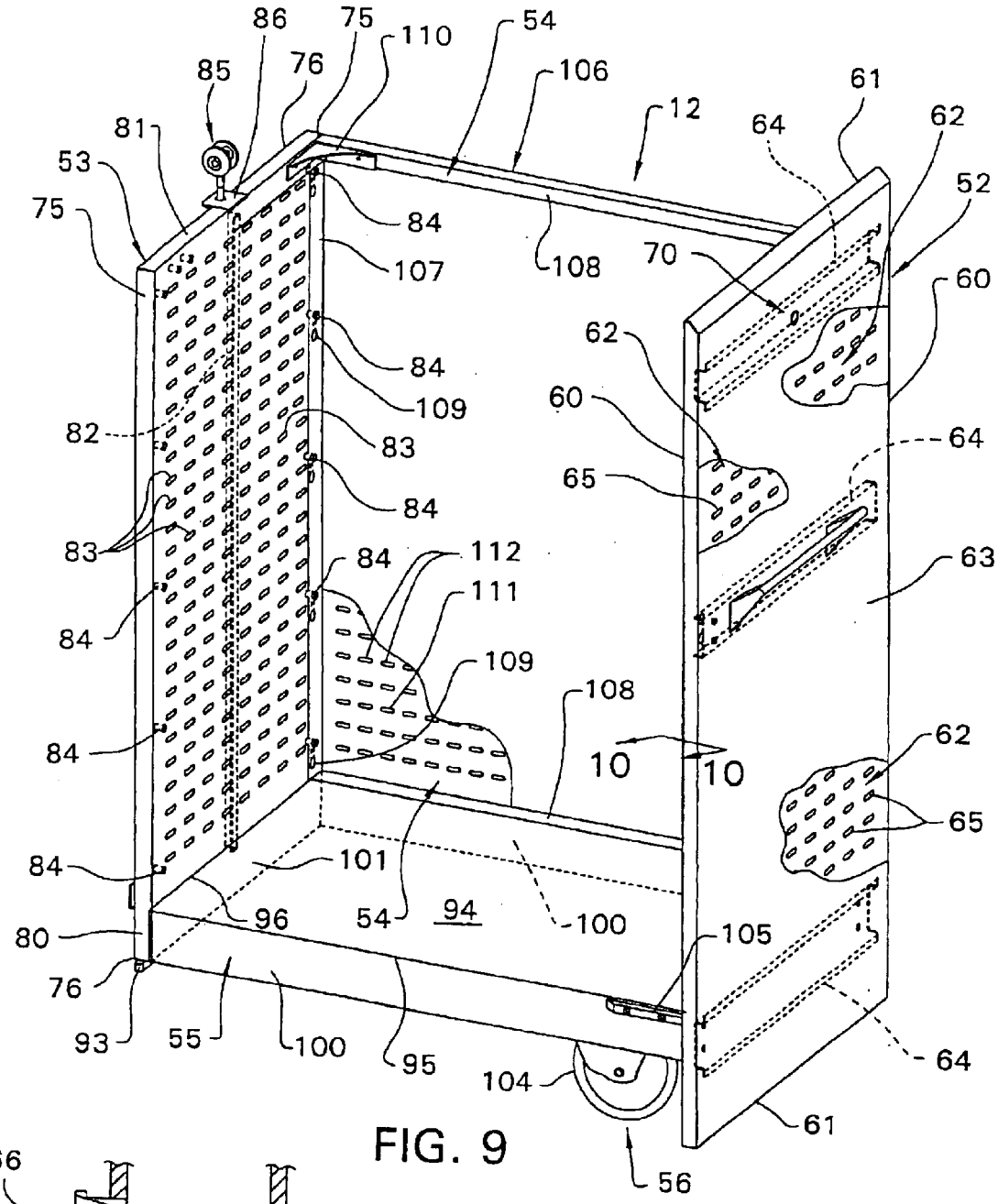
FIG. 9 is a perspective view of the cart with the panel of side wall shown only partially to illustrate the frame of side wall.
Figure 10:
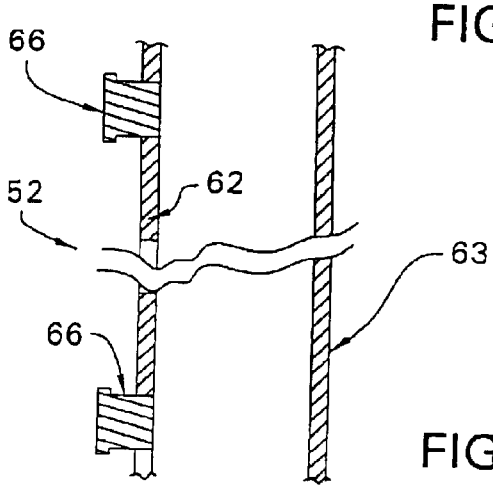
FIG. 10 is an enlarged, fragmentary, cross-sectional view of the front wall of the cart as taken generally along line 10—10 in FIG. 9.

Referring to FIGS. 6 and 9, a lock assembly 70 is mounted to front wall 52 within an uppermost one of the reinforcing elements 64. Lock assembly 70 is a conventional lock with a rotating lock barrel 71 defining a key opening therein, and a locking element or flange 72 which is mounted on an inner end of the barrel 71 for rotation therewith. The lock assembly 70 is mounted at a height such that when a key is inserted into barrel 71, the flange 72 is rotated upwardly behind face plate 51 and into the downwardly-opening channel of the rail 41 to engage the lock and prevent unauthorized opening of the cabinet 10. Further, a handle 73 is fixed to the front wall 52 and secured to the center reinforcing element 64 for manipulating the cart 12.

Turning now to rear wall 53 of cart 12, and with continued reference to FIG. 9, rear wall 53 has a pair of upright and parallel side edges 75 and upper and lower generally horizontal and parallel edges 76. A pair of side flanges 80 are bent rearwardly from side edges 75 (only one of which flanges 80 is shown), and upper and lower flanges 81 are bent rearwardly from the respective upper and lower edges 76. An elongate, generally upright and corner-shaped reinforcing element 82 is fixed to the rear wall 53 at approximately equal distances from the respective side edges 75 thereof as shown in dotted lines in FIG. 9. The rear wall 53 is provided with a plurality of slot-like openings 83 arranged in a similar pattern as openings 21 and 65. Further, a plurality of forwardly-projecting mounting pins 84, identical to pins 66 of front wall 52, are fixed to rear wall 53 along each of the respective side edges 75 thereof, and these mounting pins 84 are the same in number as, and are vertically aligned with, the respective mounting pins 66 located along the respective side edges 60 of front wall 52.

A hanger-type roller assembly 85 is mounted atop rear wall 53 for cooperation with rail 41 as discussed below. Roller assembly 85 includes a base plate 86 which is secured within an interruption of upper flange 81 of rear wall 53 and supports an upright stem 90. A pair of sidewardly-spaced rollers 91 are rotatably mounted on stem 90 through a central hub arrangement 92. As shown in FIG. 8, the rollers 91 are of a shape which corresponds to the internal configuration of the rail 41 of housing 11. More specifically, the stepped configuration of the flanges 44 corresponds to the respective shapes of the rollers 91, and the flanges 44 effectively vertically confine the rollers 91 within the rail 41. Further, the lower ribs 45 serve as lateral guides to the hub 92, and the upper ribs 46 serve to correctly position the rollers 91 on the retaining flanges 44.

As shown in FIG. 4, a pair of guides 93 are mounted on opposite sides of rear wall 53 on the bottom surface of lower flange 81 adjacent the upright side edges 75. In this regard, the guides 93 are longitudinally aligned with one another along flange 81 and are oriented in the elongated direction thereof. As shown in FIG. 9, the guides 93 project slightly horizontally beyond the respective flanges 80 of rear wall 53.

The bottom wall 55 of cart 12 is generally horizontally oriented and includes a flat, rectangular base panel 94 having parallel longitudinal edges 95 and parallel transverse edges 96. A pair of side flanges 100 are cantilevered downwardly from the respective longitudinal edges 95 and front and rear flanges 101 are cantilevered downwardly from the respective transverse edges 96. The rear flange 101 of base panel 94 is fixed to a lower portion of rear wall 53 by mounting pins (not shown), welding, or by other suitable attaching structures or methods. The front flange 101 of base panel 94 is fixed to inner wall 62 of front wall 52 in a similar manner, that is, by pins which interconnect the lower reinforcing element 64 and the front flange 101, by welding, or another suitable method.

With reference to FIG. 4, the wheel assembly 56 includes a base plate 102 which is secured to a lower surface of the base panel 94 of bottom wall 55. Further, a pair of laterally-spaced wheel mounting assemblies 103 are fixed to and project downwardly from base plate 102, and each assembly 103 mounts a wheel or roller 104 thereon. The wheel assembly 56 is secured to bottom wall 55 such that a front edge of base plate 102 lies generally along the front transverse edge 96 of base panel 94.

Figure 5:
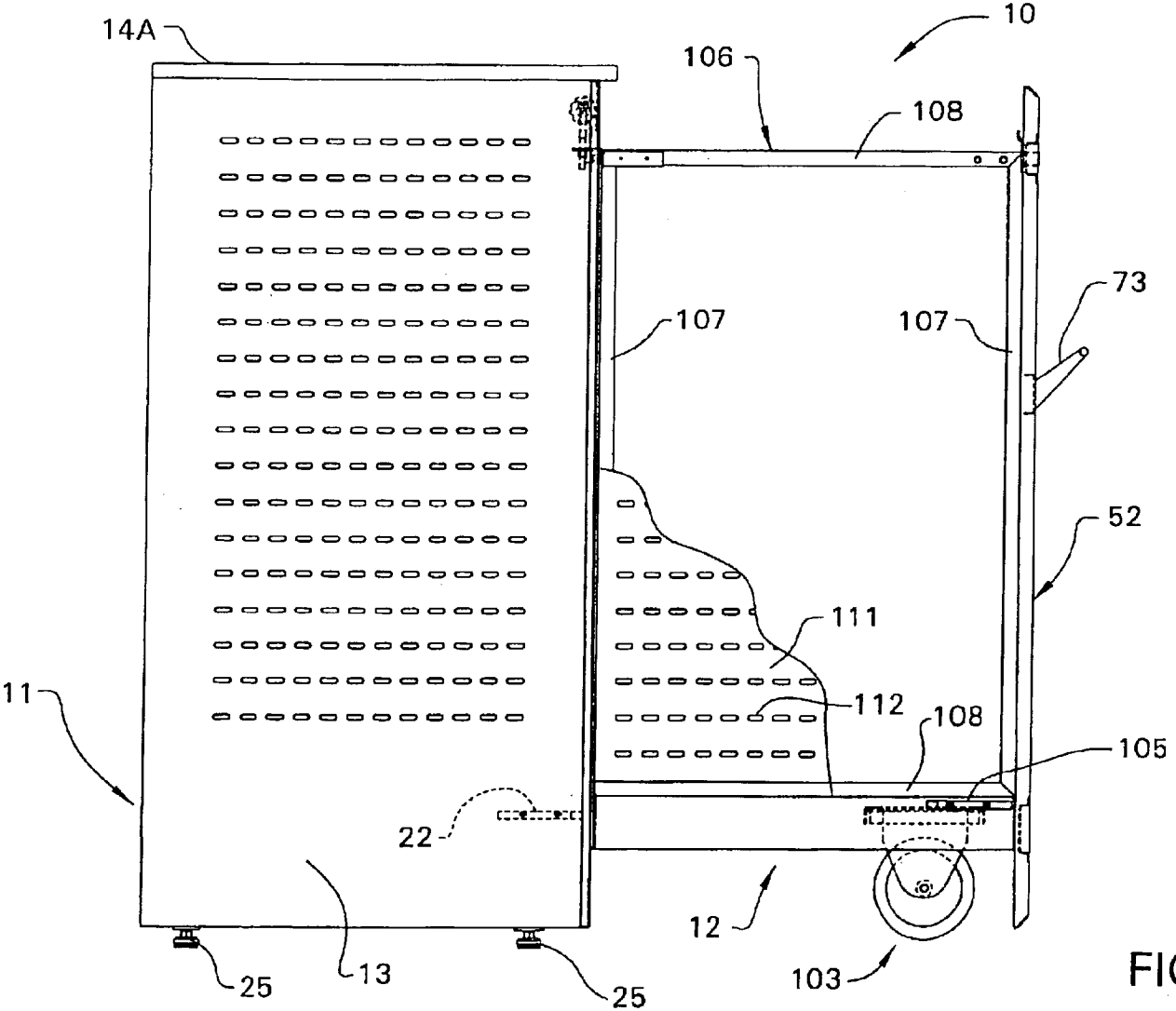
FIG. 5 is a side view of the cabinet in an open configuration.

As shown in FIGS. 4, 5 and 9, a pair of elongate and rigid guide members 105 are fixed to opposite sides of the bottom wall 55. More specifically, each side flange 100 of bottom wall 55 mounts thereon a guide member 105 adjacent to and extending in generally parallel relation with the respective longitudinal edge 95 of base panel 94. The guide members 105 are positioned so that front terminal ends thereof are disposed in closely adjacent relation with the inner wall 62 of front wall 52.

The side wall 54 of cart 12 includes a generally rectangular and open frame 106 defined by a pair of upright, generally parallel and laterally-spaced legs 107 and a pair of generally horizontal, generally parallel and vertically-spaced legs 108 which are joined to and extend transversely between the respective legs 107. Several keyhole-shaped slots 109 which are vertically spaced from one another are defined along the length of the respective legs 107 (with only the slots 109 in rear leg 107 being shown in the drawings). The vertical distance between adjacent ones of the slots 109 in each leg 107 correspond to the vertical distance between adjacent pairs of pins 66 and 84 of the front and rear walls 52 and 53, respectively. In this regard, the frame 106 is attached to the front and rear walls 52 and 53 so as to extend transversely therebetween by inserting the pins 66 and 84 into the enlarged portions of the corresponding slots 109 of the front and rear legs 107, and then shifting the frame 106 downwardly so as to engage the pins 66 and 84 within the narrow portions of the respective slots 109. Since pins 66 are provided along both vertical side edges 60 of front wall 52 and pins 84 are provided along both vertical side edges 75 of rear wall 53, as well as along both upright legs 107 of frame 106, the frame 106 may be mounted on either the right or left side of the cart 12 depending upon the user's preference. In this regard, the side wall 54 of cart 12 is shown mounted on the left side of the cabinet 10 in FIGS. 2 and 3, and on the right side in FIGS. 4, 5 and 9 for illustrative purposes. A gusset 110 is also provided at the junction of the rear upper corner of the frame 106 and the right upper corner of the rear wall 53 in FIG. 9 to provide added stability, and is secured to frame 106 and rear wall 53 with fasteners.

Side wall 54 additionally includes a panel 111 which is attached to the frame 106 by welding or other suitable attaching method so that the panel 111 extends across substantially the entire frame 106 so as to cover same. Further, panel 111 defines therein a plurality of slot-like openings 112 arranged in a pattern similar to the openings 21, 65 and 83. The cart 12 thus has a four-sided construction defined by the side, front, rear and bottom walls which opens both sidewardly and upwardly.

The cart 12 is sized so as to fit wholly within housing 11. In this regard, the cart 12 is assembled with the housing 11 prior to attachment of the face plate 51 by inserting roller assembly 85 into the open front end of the rail 41 and sliding the cart rearwardly 12 and into the housing 11. The face plate 51 is then attached to the front of the housing 11 and the front end of rail 41 so as to prevent complete separation of the cart 12 from the housing 11.

The cart 12 is movable relative to the housing 11 between a retracted storage position illustrated in FIG. 1, and an extended use position illustrated in FIGS. 2–5. The positions of the cart 12 illustrated in FIGS. 2–5 allow access to the interior of the cabinet 10. During movement of the cart 12 relative to the housing 11, the guides 93 located on the bottom rear of the cart 12 ride along the inner surfaces of the respective side walls 13 of housing 11 so as to laterally guide movement of the cart 12. Further, the guide members 22 of the housing 11 are located at a height relative to the respective guide members 105 of cart 12 such that when the cart 12 is moved into the fully retracted storage position (FIG. 1), the guide members 22 are located under and are engaged with the respective guide members 105, and effectively lift the front end of the cart 12 a slight amount. This positioning of the guide members 105 atop the respective guide members 22 of housing 11 when cart 12 is in the closed position prevents unauthorized opening of the cabinet 10. That is, the front end of the cart 12 is effectively carried on and supported by the front end of the housing 11 in the storage position through the positioning of guide members 105 atop the respective guide members 22, which prevents disengagement of lock assembly 70 by lifting the front end of the housing 11. Otherwise, when the cart 12 is in the storage position and the lock assembly 70 is in the locked position with the flange 72 rotated behind face plate 51, the lock could be disengaged by lifting the front end of the housing 11 relative to the cart 12. However, with the arrangement according to the invention, when the front end of the housing 11 is lifted, the front end of the cart 12 is also lifted, which prevents disengagement of the lock assembly 70.

Figure 11:
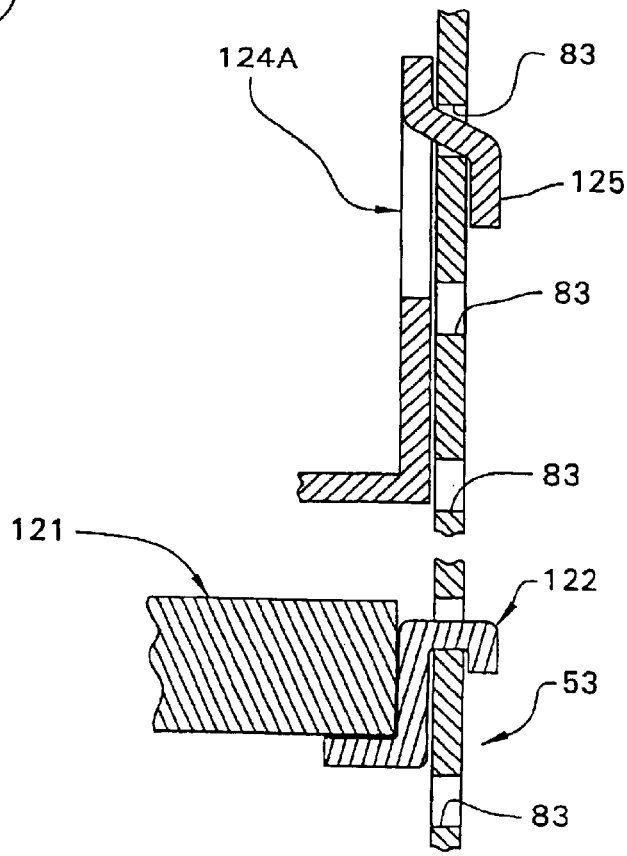
FIG. 11 is an enlarged, cross-sectional view of a shelf and an office accessory mounted on the cart.

As shown in FIGS. 1–3, various accessories are mountable on the cart 12. For example, FIG. 3 shows a whiteboard panel 120 which is suspendable from an upper edge of the side wall 54 of cart 12 by means of a hook arrangement (not shown). The whiteboard panel 120 provides a surface upon which notes, reminders or other information can written and dry erased. The whiteboard panel 120 can be made of a magnetic material to allow posting of notes or other materials with magnets. Further, shelves 121 can be mounted so as to extend between front and rear walls 52 and 53 of cart 12 as shown in FIG. 2. In this regard, mounting brackets 122 are utilized to support the opposite transverse edges of each shelf 121. The mounting brackets 122 engage within the appropriate slot-like openings 65 and 83 of front and rear walls 52 and 53 (see FIG. 11). These shelves 121 may be used for storing work-related items or to support boxes or bins 123 for storing documents in hanging file folders or otherwise. Other accessories such as a pencil box 124, a business card holder 124A, a picture frame etc. may be mounted on the inner sides of the front, rear and side walls of the cart 12 through hangers or hooks 125 which may be integrally formed as part of the accessory as shown in FIG. 11, or may be separate components. As shown in FIGS. 1 and 2, accessories may also be mounted on the exterior surfaces of the side walls 13 of the housing 11 via slots 21.

The storage cabinet 10 according to the invention incorporates therein an improved arrangement for supporting and permitting movement of a drawer-type cart 12, including a single centered rail or track 41 which supports the cart 12 from the top center, and a wheel or roller assembly 56 which supports the cart 12 at the lower front end. This three-point support of cart 12 allows a limited amount of racking or twisting of the cart 12 relative to the housing 11 and about the rail 41 which prevents binding of the cart 12 during movement thereof into and out of the housing 11.

The storage cabinet 10 according to the invention may be provided in various sizes. For example, the embodiment disclosed herein is available in both two and four foot heights.

In the illustrated embodiment, the side and rear walls of housing 11, as well as the front, side, rear and bottom walls of cart 12 are constructed of sheet metal, such as steel, and the walls of housing 11 and walls of cart 12 may be joined together by welding and/or suitable fasteners to achieve the structures disclosed herein.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A storage cabinet comprising:

a housing supported on a floor surface and defined by a pair of generally vertically oriented side walls joined together by a generally horizontally oriented top wall, said housing defining therein an interior storage compartment which opens frontwardly through an open front end of said housing for access to said storage compartment, and an elongate track mounted under said top wall generally centrally between said side walls; and a cart disposed for eliding movement relative to said housing between a stored position wherein said cart is disposed within said storage compartment of said housing and an open position wherein said cart extends outwardly of said housing and through said open front end thereof, said cart having a generally vertically oriented front wall which closes off said open front end of said housing when said cart is in said stored position, a first roller arrangement mounted on a lower front end of said cart and disposed in supportive engagement with the floor surface, and a second roller arrangement mounted on an upper rear portion of said cart along a central longitudinal axis thereof and which is rollingly engaged within said track of said housing to support said cart in a suspended maimer from said housing.

2. The storage cabinet of claim 1 wherein said cart includes a generally vertically oriented rear wall disposed in spaced-apart relation with said front wall and a generally vertically oriented side wall which extends transversely between said front and rear walls, said front, side and rear walls of said cart together defining a storage area which opens sidewardly.

3. The storage cabinet of claim 2 wherein said cart includes a generally horizontally oriented bottom wall which extends transversely between said front and rear walls, said side wall of said cart being disposed along and projecting upwardly from a longitudinal edge of said bottom wall, and said first roller arrangement being mounted adjacent a front portion of said bottom wall.

4. The storage cabinet of claim 2 wherein said front, rear and side walls of said cart define therein slot-like openings which permit mounting of accessories within said storage area.

5. The storage cabinet of claim 1 wherein said first roller arrangement is the sole roller arrangement mounted on said lower end of said cart such that said cart does not engage the floor surface except through said first roller arrangement, and a rear end of said cart is supported in a suspended manner from said housing by said second roller arrangement.

6. The storage cabinet of claim 5 wherein said first roller arrangement includes a pair of rollers mounted at respective front lower corners of said cart, and said second roller arrangement includes a single roller mounted on said upper rear portion of said cart, said pair of rollers and said single roller being the sole points of support for said cart.

7. The storage cabinet of claim 1 wherein said front wall of said cart mounts thereon a lock which is engageable with a portion of said housing to lock said cart in said stored position to prevent access to an interior of said cart, and a handle for moving said cart between said stored and open positions.

8. The storage cabinet of claim 7 wherein a first pair of guides are mounted adjacent respective opposite sides of said lower front end of said cart and a second pair of guides are mounted adjacent respective opposite sides of said lower front end of said housing, said second guides being disposed in supportive engagement with the respective first guides in said stored position of said cart to prevent disengagement of said lock by an unauthorized person by lifting of said housing.

9. The storage cabinet of claim 1 wherein a pair of guides are provided on opposite sides of a lower rear end of said cart for providing lateral guidance of said cart relative to said housing during movement between said stored and open positions.

10. A storage unit, such as for use in an office, said storage unit comprising:

a housing defining a generally hollow interior which opens forwardly through an open front end and is supported on a floor surface, said housing mounting thereon a rail adjacent an upper end and located centrally thereof; and a drawer disposed within said open front end and slidably movable between a closed position wherein said drawer is disposed within said housing and an open position wherein said drawer projects outwardly through said open front end of said housing, a lower front end of said drawer being supported on the floor surface by a first roller assembly which engages the floor surface and an upper rear end of said drawer being supported on the housing by a second roller assembly which rollingly engages said rail and is mounted along a central longitudinal axis of said drawer.

11. The storage unit of claim 10 wherein said second roller assembly includes a roller element which is captivated within said rail such that said upper rear end of said drawer is suspended from said rail.

12. The storage unit of claim 11 wherein said upper rear end of said drawer is supported solely through the captivation of said roller element within said rail such that said drawer does not engage the floor surface except through said first roller assembly.

13. The storage unit of claim 10 wherein said first roller assembly includes a pair of laterally-spaced rollers respectively disposed adjacent front corners of said drawer and in rolling contact with the floor surface.

14. The storage unit of claim 13 wherein said rail is elongate and has a downwardly-opening U-shape in transverse cross section, and said second roller assembly includes a roller element captivated within said rail such that said roller element is rollingly engaged within said rail to allow movement of said drawer relative to said housing between said closed and open positions.

15. The storage unit of claim 14 wherein the U-shape of said rail is defined by a pair of generally upright side walls interconnected by a top wall which extends transversely between said side walls, and a pair of retaining flanges project inwardly and towards one another from lower end portions of the respective side walls in generally parallel relation with said top wall, said roller element engaging said retaining flanges to maintain said roller element within said rail.

16. The storage unit of claim 10 wherein said housing includes a pair of upright, laterally-spaced and generally parallel side walls, an upright rear wall extending laterally between rear upright edges of said side walls and a horizontally oriented top wall extending between upper horizontal edges of said side and rear walls, said side, rear and top walls together defining said hollow interior which opens through said open front end, said drawer including an upright front wall and an upright rear wall which is spaced rearwardly from said front wall and is generally parallel thereto, a side wall extending between opposed upright edges of said front and rear walls of said drawer, and a bottom wall extending between lower horizontal edges of said side, front and rear walls of said drawer, and said side wall of said drawer projecting upwardly from one longitudinal side edge of said bottom wall of said drawer such that said drawer defines therein a hollow interior which opens sidewardly towards one of said side walls of said housing.

17. The storage unit of claim 16 wherein said rail is mounted beneath said top wall of said housing so as to extend in a front-to-back direction thereof and is centered between said upper horizontal edges of said side walls of said housing, said first roller assembly including a pair of rollers respectively mounted at opposite front corners of said bottom wall of said drawer, and said second roller assembly being mounted adjacent an upper horizontal edge of said rear wall of said drawer and captivated within said rail so as to suspend a rear end portion of said drawer from said housing.

18. The storage unit of claim 10 wherein said second roller assembly is mounted on said upper rear end of said drawer along said central longitudinal axis thereof.

19. A storage cabinet comprising:

a housing supported on a floor and defined by upright side walls and a generally horizontal top wall which interconnects said side walls, said side and top walls together defining a hollow interior space which opens sidewardly through an access opening; and a cart connected to said housing and storable within said hollow space thereof, said cart being slidably movable outwardly from said housing through said access opening into an extended use position, said cart having a wall structure which defines a storage area for storing work-related items and a front wall which closes off said access opening when said cart is stored within said housing, said cart including a wheel arrangement disposed on a lower end portion of said cart for engagement with the floor, and an upper end portion of said cart being slidably connected to said housing adjacent an underside of said top wall centrally thereof by a connector mounted on a central axis of said cart.

20. The storage cabinet of claim 19 wherein said connector is mounted on said upper end portion of said cart and comprises a roller, and said housing mounts thereon an elongate track which opens downwardly and receives therein said roller, said roller being captivated within said track such that a rear end portion of said cart is suspended from said housing.

21. The storage cabinet of claim 20 wherein said wheel arrangement is mounted on a lower front end of said cart such that said cart is supported on a floor at said lower front end thereof by said wheel arrangement, and said cart is suspendingly supported at said rear end portion thereof through the captivation of said roller within said track of said housing.

22. The storage cabinet of claim 19 wherein said wall structure of said cart includes a rear wall which is generally parallel to and spaced rearwardly from said front wall, a side wall extending between upright vertical edges of said front and rear walls of said cart, and a bottom wall disposed at lower horizontal edges of said front, rear and side walls of said cart, said side wall of said cart being disposed along one longitudinal side edge of said bottom wall, wherein inner surfaces of said front, side and rear walls of said cart are configured for mounting at least one work-related accessory thereon.

23. The storage cabinet of claim 22 wherein said accessory comprises a generally horizontally oriented shelf which extends between said front and rear walls and along said side wall of said cart.

24. The storage cabinet of claim 19 wherein said upper end portion of said cart mounts said connector thereon which is fastened to said housing adjacent said underside of said top wall thereof and allows sliding movement of said cart relative to said housing.

25. The storage cabinet of claim 24 wherein said connecter comprises a roller which is captivated within an elongate track mounted on said housing.

26. A cabinet comprising a housing supported on a floor and defining a generally hollow interior, and a cart movable into and out of said hollow interior and defining a centrally located longitudinal axis, said cart including a first support arrangement disposed at a lower end of said cart for moving engagement with the floor and a second support arrangement disposed at an upper end centrally of said cart, said first and second support arrangements being longitudinally spaced from one another at opposite ends of said cart, said second support arrangement including a support element centrally fixed to said upper end of said cart along the longitudinal axis thereof, said support element being slidably engaged with and vertically supported centrally by said housing to permit movement of said cart relative thereto.

27. The cabinet of claim 26 wherein said first support arrangement includes a pair of rollers at one end of said cart on opposite sides of the longitudinal axis thereof, said rollers and said support element defining the sole supports for said cart.

28. The cabinet of claim 26 wherein said hollow interior opens forwardly through an open front end of said housing and said cart includes a front wall which closes off said hollow interior of said housing when said cart is in a fully stored position within said hollow interior, and said housing defines an elongate track adjacent a top wall thereof which is aligned with and extends along the longitudinal axis of said cart, said support element being slidably engaged with said track to permit movement of said cart into and out of said housing.

29. The cabinet of claim 28 wherein said housing includes a pair of generally upright and laterally spaced side walls interconnected by said top wall, and a generally upright rear wall extending transversely relative to said top and side walls, said hollow interior opening forwardly in a direction away from said rear wall, said first support arrangement including a pair of rollers disposed on opposite sides of the longitudinal axis and adjacent respective front lower corner regions of said cart, and said support element comprising a roller mounted to a generally upright rear wall of said cart which is generally parallel to said rear wall of said housing.

* * * * *

UNITED STATES PATENT AND TRADEMARK OFFICE

CERTIFICATE OF CORRECTION

PATENT NO. : 6,824,231 B2
DATED : November 30, 2004
INVENTOR(S) : Rupert Jakob-Bamberg et al.

It is certified that error appears in the above-identified patent and that said Letters Patent is hereby corrected as shown below:

Column 8,
Line 26, change “eliding” to -- sliding --.
Line 40, change “maimer” to -- manner --.

Signed and Sealed this

Tenth Day of May, 2005

JON W. DUDAS
*Director of the United States Patent and Trademark Office*